United States Patent [19]

O'Brien

[11] 4,399,750

[45] Aug. 23, 1983

[54] CAMMING PLATEN ENDORSER

[75] Inventor: Thomas M. O'Brien, Redford, Mich.

[73] Assignee: Burroughs Corporation, Detroit, Mich.

[21] Appl. No.: 240,204

[22] Filed: Mar. 3, 1981

[51] Int. Cl.[3] ..... B41F 13/24

[52] U.S. Cl. ..... 101/245; 101/376; 101/235; 101/233

[58] Field of Search ..... 101/232, 233, 234, 235, 101/242, 245, 76, 91, 52, 246, 247, 376, 375

[56] References Cited

U.S. PATENT DOCUMENTS

| | | | |
|---|---|---|---|
| 2,062,876 | 12/1936 | Gerrmann | 101/233 X |
| 2,083,862 | 6/1937 | Paxton | 101/235 X |
| 2,120,247 | 6/1938 | Funk et al. | 101/235 X |
| 2,214,751 | 9/1940 | Pierce | 101/233 |
| 2,895,413 | 7/1959 | Ritzerfeld et al. | 101/91 X |
| 3,217,639 | 11/1965 | Kelly | 101/233 |
| 3,453,955 | 7/1969 | Seel et al. | 101/415.1 X |
| 3,903,794 | 9/1975 | Grupe et al. | 101/376 |

*Primary Examiner*—Edgar S. Burr
*Assistant Examiner*—Charles A. Pearson
*Attorney, Agent, or Firm*—Delbert P. Warner; Kevin R. Peterson

[57] ABSTRACT

An endorser for document processing machines is provided with means for controlling the application of an endorsement in a manner which reduces the deleterious effects of impaction previously encountered when printing endorsements and at the same time affords certain other advantages. The system employs camming means operating through lever means to control the impact in a manner which converts a point load to a shear load while reducing power requirements to a driving motor and making it possible to cope with documents of varied thicknesses. The system makes it possible to convert some of the energy otherwise wasted in the system to accelerate the platen and thus reduce motor power requirements.

4 Claims, 5 Drawing Figures

CAMMING PLATEN ENDORSER

BACKGROUND OF THE INVENTION

1. Field of the Invention

The invention relates to printing devices for document processing machines. More particularly, it relates to rotary impact endorsers for such machines and to improvements which assure more favorable load configurations for rotary impact endorsers.

2. Description of the Prior Art

Prior art stamp endorsers employed with document processing machines have included endorse-on-demand mechanisms relying on print heads rotationally impacting against a document currently passing an endorse station, including a platen at rest, as illustrated in FIG. 1. The print head rotates to bring the stamp die to bear against the document and platen; and, having been inked, the die carried by the print head leaves an impression on the document. The print head then continues to rotate, disengaging the platen, past an inking roller until it reaches a home position.

Such prior art systems have proven to be acceptable when print head velocities are low with proportionately low impact torques as in presently used moderate speed systems where document track speed approximates 12 inches per second. Systems employing higher track speeds, of the order of 75 inches per second, have been achieved in the past on early model low speed machines by use of essentially a brute force approach in which a relatively large motor was used to maintain momentum and supply significant torque through print head engagement impact. This brute force approach has proven reliable, but has its disadvantages. The disadvantages include requirements for larger and costlier motors and the existence of higher mechanism bearing loads due to high platen spring preloading.

The stamp endorser for a more recent higher speed machine is required to perform for over 40 million endorse cycles while reaching a track speed on the order of 100 inches per second. The endorser is allotted a space adjacent to the track which dictates either a small motor (about 2 inches in diameter) for directly driving the print head on the motor shaft or a remotely mounted larger motor with a drive system, typically comprising belts or gearing. Small motors predictably generate low torques which have been found to present a problem in such cases, where a large engagement torque has to be overcome while a constant speed is maintained. Larger motors employing a drive system add significantly to cost and complexity in addition to requiring comparatively large, expensive platen roller and pivot bearings and bearing structures as a result of the high platen spring loads needed. Also, if a reasonably low spring rate is to be employed, the spring size increases significantly. In a system to which the present invention has been applied, considering the space allotted as dictated by the document size capabilities specified for the system, difficulties would have been encountered in adapting a platen structure for a "brute force" mechanism.

In addition to the foregoing, the higher speed machines have problems of reliability with the print heads which is also a result of the impact at engagement. The potential exists for the impact against a localized area of the stamp, specifically the leading edge, to peel the stamp away from the print head. This is not a problem on some endorsers where an indexing metal print wheel is located at the print head edge to absorb impact. However, problems of peeling stamps are experienced on moderate speed endorsers in which a rubber stamp edge absorbs the impact. Incidences of peeling may be expected to rise on a similar higher speed endorser with its much higher operating speed.

It becomes apparent then that edge or engagement impact is a great detriment. It has been determined to cause decreases in both performance and reliability in direct proportion to increases in impact forces.

A prior art solution to the problem of edge impact has been to convert the instantaneous edge rise into a gradual rise by incorporating a "ramp" into the stamp leading edge. In effect this "ramp" then is a cam profile and the platen acts as a cam follower. This approach is an improvement and in fact, to this end, a slight chamfer is applied on the current stamp edges. When considerations are made for variations in document thickness, the inherent looseness of bonded rubber stamp print head tolerances and swelling of stamps in the presence of hydrocarbon inks it is found that the rise can be significant. It is especially significant, since it occurs at a time in the cycle when additional torque is needed to accelerate the print head to speed.

SUMMARY OF THE INVENTION

The invention relates to rotary impact endorsers for use with document processing machines. In a preferred embodiment a platen and a print head are oriented on opposite sides of a track along which documents are transmitted. The print head bears a stamp for use in printing endorsements on documents moving along the document track. The platen serves as backing for documents as print is applied. Driving means are coupled to the print head, causing it to rotate in a manner enabling the stamp to contact a document present in the track and to enable other parts of the print head to remain out of contact with any documents in the track. A cam is coupled to the driving means to rotate as the driving means turns. A cam follower roller is positioned to contact the cam during part of each revolution of the cam. A linkage between the cam follower roller and the platen is used to move the platen in and out of contact with a document in the track synchronously with the rotation of the print head to enable the stamp to endorse documents in the track.

DESCRIPTION OF A PREFERRED EMBODIMENT

Figure 1:
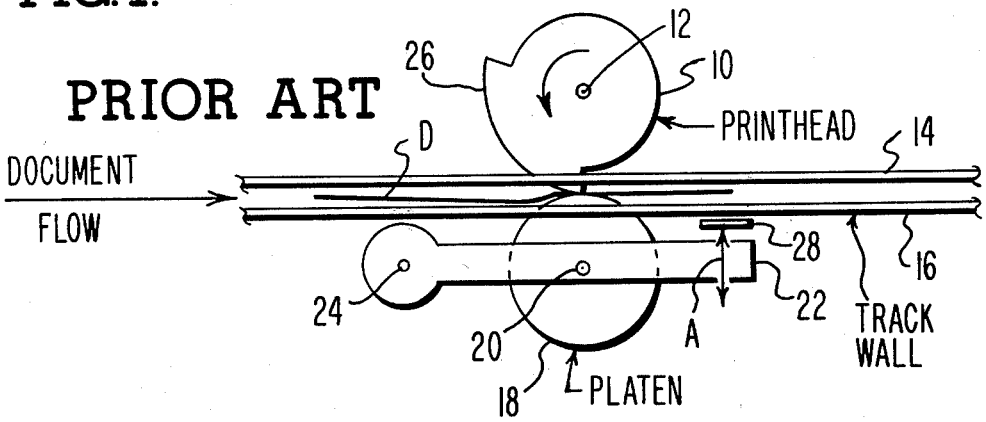
FIG. 1. PRIOR ART
FIG. 1 is a schematic diagram illustrating an endorser according to the prior art.

Turn first to FIG. 1, for a plan view of the general arrangement of a rotary impact endorser. A print head is shown at 10 in a position to rotate about a shaft 12 which is fixed in position relative to track walls at 14 and 16. A platen, shown at 18, is supported on a shaft 20 by an arm 22 which pivots about a shaft 24 to enable motion in directions indicated by the two-headed arrow A. A document at D is shown in position as it starts to receive printing from a die at 26 on the print head 10. A stop at 28 limits motion of the arm 22. The arm 22 is urged, by a spring or other element which is not shown, to press the platen against die 26 on the print head or, alternatively, when the die is turned away from the platen, to press the arm itself against the stop 28.

Figure 2:
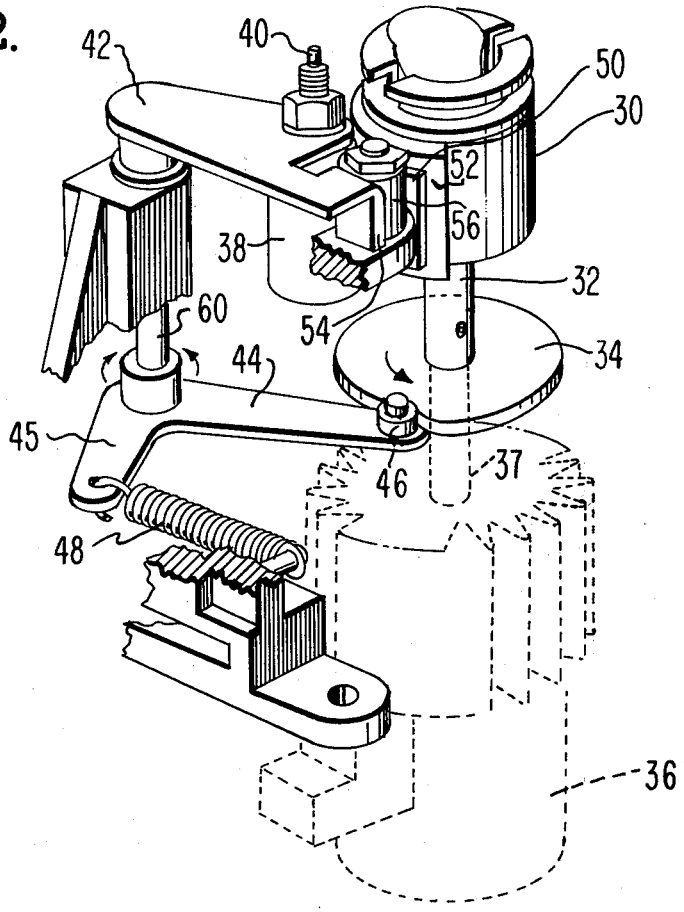
FIG. 2 is a perspective view showing an embodiment of the invention.

Turning now to FIG. 2, in which is shown a preferred embodiment of the invention, it will be seen that a print head at 30 is positioned on a supporting shaft 37 to rotate as the shaft is turned by a motor 36. A platen at 38 is positioned to rotate freely about a shaft, an end of which is visible at 40. With this arrangement it will be seen that the print head and the platen are positioned to allow documents to pass along a track between them in a manner similar to that shown in FIG. 1.

A cam 34, held by a sleeve 32 on the motor shaft 37, is turned by the motor 36. Extending out to the cam face is an arm 44 with a follower roller 46 mounted thereon. The arm 44 includes a branch 45 to which a spring 48 is mounted to urge the follower roller 46 to bear against the face of the cam 34. Motion of the arm 44, in response to contact of roller 46 with the face of the cam 34, is transmitted by the shaft 60 to an arm 42. The arm 42 causes platen 38 to press a document against the stamp 50, on the face 52 of the print head, as the stamp is rotated into position by the print head. This causes the platen brake 54 to bear against a bumper 56 thereby preventing the platen from striking other elements of the print head as the print head turns the stamp 50 to a position away from the platen and also minimizes the energy required to reposition the platen and causes a tangential collision between the cam and the cam follower rather than a radial collision.

Figure 3:
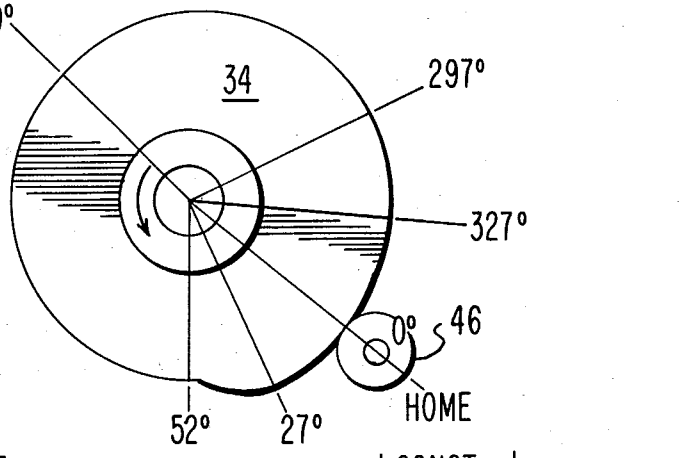
FIG. 3 is a plan view showing a cam and associated follower roller in accordance with the invention.
Figure 4:
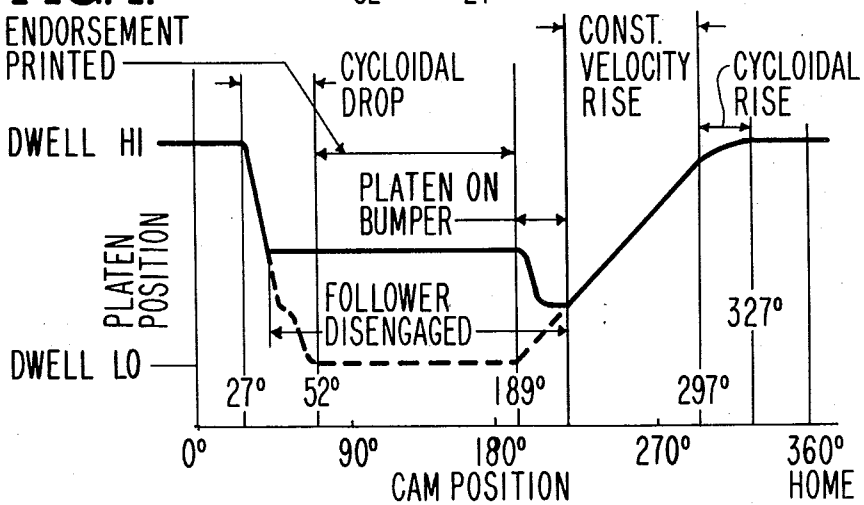
FIG. 4 is a graph depicting relationships between the platen positions and the corresponding cam positions as the cam rotates through 360 degrees.

The cam 34 is mounted on the motor shaft 37 in such a way that in the home position, which is shown at 0 degrees on the cam in FIG. 3 and on the chart in FIG. 4, the platen 38 is held out of the track by the follower roller 46 resting atop the high dwell portion of the cam. Motor rotation is started after a document is sensed in the track by means not shown and, for the first twenty-seven degrees, the motir is accelerated to speed with the platen held at the high dwell position. Once accelerated, the cam profile undergoes a cycloidal "drop" (from 27 degrees to 52 degrees) allowing the platen to rotate into the track path where it comes to bear against the document and thereby presses the document against the stamp. After contact (at 52 degrees) is established between the platen, a document, and the stamp, the print head continues to rotate the stamp past the platen until the endorsement is complete at about 189 degrees on the cam. Once the stamp has passed the platen, the platen is free to rotate further into the track which it does until the tab face or brake 54 on the platen bracket impacts an eccentric rubber bumper 56 and comes to rest. The cam profile, which had been cut down to a radius selected to insure no follower-cam contact during endorsement, begins a linear increase in radius once the stamp has passed beyond the point where it could contact the platen.

Approximately twenty degrees after the stamp has passed the platen and with the platen bracket resting on the bumper, the cam follower engages the constantly increasing cam profile and proceeds to rotate the platen out from the track until it reaches the high dwell level. This rotation takes place over approximately 120 degrees during which the stamp engages the inking transfer roll (not shown) and is replenished for the next endorsement. Upon reaching the high dwell level, the motor continues to rotate another thirty-three degrees (from 327 degrees-360 degrees) to the home position where it is stopped and awaits the signal to begin another endorsement cycle.

Having reviewed the basic action of an embodiment of the invention in the preceeding section, it is felt that certain aspects of the invention merit further discussion.

The first aspect is the cycloidal drop segment of the cam profile shown between 27 degrees and 52 degrees in FIGS. 3 and 4. In a particular embodiment, the drop at the cam face translates to a drop at the platen owing to the follower arm geometry. The drop occurs through a maximum of 25 degrees (between 27 degrees and 52 degrees) selected to assure that contact with the cam-follower roller 46 does not occur during endorsement. The reason for the fairly large drop and the approximate drop angle is to allow for possible variations of stamp and document thickness mentioned earlier. Because of those variations, the platen must be rotated far enough out of the track to allow the document and stamp lead edge to pass the platen without interfering, thus avoiding edge impact. Also, as a result of thickness variations, the platen can be expected to engage the stamp over a wide range of the drop. Printing will also commence at some point during the drop, meaning that this portion of the stamp cannot be relied upon for printing a legend. The first twenty degrees of stamp covering the final twenty degrees of drop is, as a result, a blank rubber pad which absorbs the impact of landing and the shear force to accelerate the platen roll to track speed. Following the blank pad is the character die, or stamp, 50. The ideal situation would be to have a platen which dropped instantaneously to stamp level. The present invention embodies adaptations to system constraints which dictate low motor inertial loads.

Figure 5:
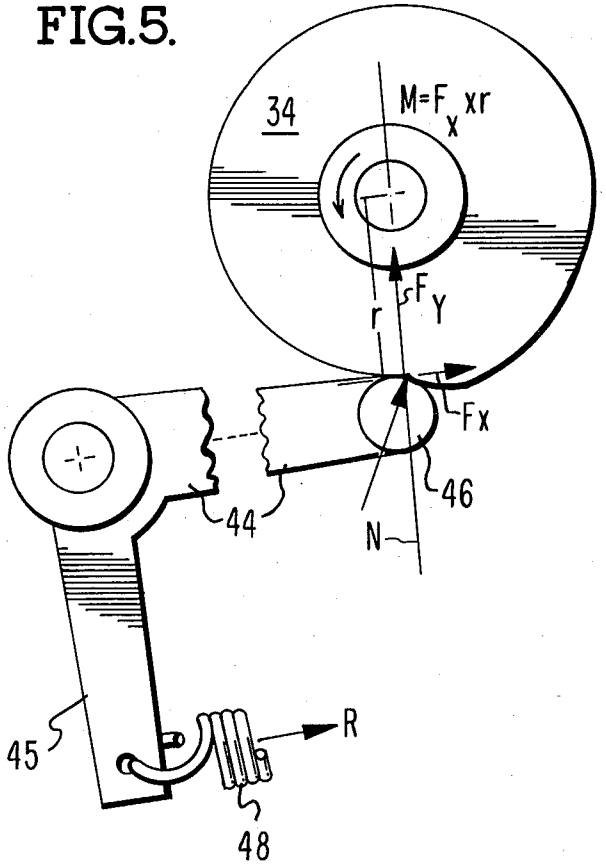
FIG. 5 is a free body diagram showing positions of the cam and follower at one point in the cycloidal drop and including a vector diagram showing the relationships of forces acting between the cam and the follower.

An interesting aspect of the cycloidal drop segment is the load inverting characteristic it imparts to the mechanism. As mentioned previously, earlier devices apply a torque in opposition to the motor at impact to overcome inertia and rotate the platen out from the track. Using the present camming system, it is actually possible to impart a portion of the stored spring energy released through the platen drop as torque to the motor shaft. This is apparent from FIG. 5 which shows a free body diagram of the cam and follower at one point of the drop. The resolved component of spring load, $F_x$, will act through a moment arm equal to the cam radius r at the point of contact to add to motor torque. In some embodiments this advantage may be abandoned, however, because at the speed which the motor rotates, the spring load would have to be more than doubled to exert an appreciable $F_x$ and by minimizing spring load, larger more expensive bearing structures are avoided.

The critical loading on this system occurs at the point where the follower roller 46 re-engages the cam 34 after the platen 30 and arm assembly have come to rest on the bumper. Theoretically, since the platen assembly attains an instantaneous velocity corresponding to the constant radial increase of the cam profile, acceleration and therefore force at the face of the cam acting on the follower will be infinite. In fact, it would require an infinitely rigid platen and arm structure for such a catastrophe to occur, which is far from the actual case. In a preferred embodiment, best estimates of the actual force based on print head velocity vs. time data is approximately 6 lbs. which is tolerable.

Another aspect of the invention to be considered concerns the print head inking procedure. A relevant question regarding this endorser is "If all this care has been taken to avoid edge impact at platen-print head engagement, why is edge impact tolerated for print head-transfer roll engagement?" The answer is that there is in fact significant impact and that the print head velocity drops noticeably. However, at that point of the cycle, the print head is disengaged from the platen and documents are free to pass. This avoids the possibility of either smearing the endorsement or losing the document gap due to slippage in the track drive with a slowed print head controlling document speed. The print head recovers rapidly from the impact, returns to speed and completes the cycle with a reasonable time margin to be ready for the next cycle. This impact also will have the tendency to peel the stamp away but is not perceived to be as harmful to the bond because the roll is larger, made with softer rubber, there are no abrasive or variable thickness documents between rolls and the ink itself acts as a lubricant between roll surfaces.

A camming platen printing system according to the present inventions affords several advantages, including the following. 1. An avoidance of edge impacting by the print head stamp against the document and platen roll with resultant lowering of motor power requirements to maintain constant track speed. 2. As a side benefit of avoiding the impact, greater longevity of the stamp-to-print head bond is realized by converting the point load which acts to peel the stamp from the head to a shear load resisted by the far larger stamp landing pad area. 3. A print-on-demand system which could print a legend on documents of essentially infinite variation in document thickness. This can be accomplished by varying the cam profile and motor power to accommodate a system maximum thickness document. For example, if mail could be conveyed by an endorse station, the endorser could be employed to cancel stamps. 4. Making it possible to convert some of the energy stored in the platen spring to input torque for accelerating the print head previous to platen engagement. In this way it is also possible to lower motor power requirements.

What is claimed is:

1. In a document processing machine incorporating a rotary impact endorser, the combination comprising:

a document track bounded by two walls between which documents are driven;

said walls including openings therethrough;

a platen and a print head positioned along opposite sides of the document track and including portions which can be extended through the openings in the walls;

the print head bearing a stamp for use in providing printed endorsements to documents moving along the document track;

driving means coupled to said print head to rotate the print head between positions in which the stamp is enabled to contact a document in the track and positions in which other parts of the print head remain free of contact with a document in the track;

a cam coupled to said driving means to be revolved thereby;

a cam follower roller;

linkage means providing a coupling between the platen and the cam follower roller; and biasing means coupled to said linkage to urge the cam follower into contact with the cam and to urge the platen toward the print head;

means to absorb landing and shear forces imparted through the linkage from said biasing means when the print head engages the platen, said means comprising a blank rubber pad forming a first portion of the face of the stamp;

said blank rubber pad serving to convert some of the energy absorbed into torque to drive the platen;

the cam follower roller being positioned by the linkage means to contact the cam during a portion of each revolution of the cam, whereby the platen is moved in and out of contact with a document in the track synchronously with the rotation of the print head to enable the stamp to provide endorsements to documents in the track and to prevent edge impact between the stamp and the platen.

2. The invention as claimed in claim 1, in which:

the linkage means includes an arm coupled mechanically to a second arm, said second arm supporting the platen as it moves in and out of contact with a document in the track.

3. The invention as claimed in claim 1 or 2, in which:

a platen brake is provided for the linkage means, and a bumper is positioned to engage said platen brake and prevent the platen from engaging the print head during portions of the revolution of the cam during which no printing is required.

4. The invention as claimed in claim 3, in which:

the cam is shaped to provide for the gradual application of force between the print head and the platen, whereby the deleterious effects of impact are reduced between the print head and the platen.

* * * * *